United States Patent [19]

Zajac

[11] 4,022,399

[45] May 10, 1977

[54] SCREW-IN TUBE WITH BREAKABLE TABS FOR COIL OF FLEXIBLE MATERIAL WITH INNER END PAYOUT

[75] Inventor: Ronald E. Zajac, Yonkers, N.Y.

[73] Assignee: Windings, Inc., New York, N.Y.

[22] Filed: June 1, 1976

[21] Appl. No.: 691,617

[52] U.S. Cl. ..... 242/163; 242/137.1; 242/157 R; 242/171

[51] Int. Cl.[2] ..... B65H 55/02

[58] Field of Search ..... 242/163, 159, 170, 171, 242/172, 129, 137, 137.1, 138, 141, 146, 128, 157 R

[56] References Cited

UNITED STATES PATENTS

| | | | |
|---|---|---|---|
| 2,634,922 | 4/1953 | Taylor, Jr. | 242/163 |
| 2,716,008 | 8/1955 | Taylor, Jr. | 242/163 |
| 2,738,145 | 3/1956 | Taylor, Jr. | 242/163 |
| 3,677,490 | 7/1972 | Gordon et al. | 242/163 |
| 3,677,491 | 7/1972 | Gerwig | 242/163 |
| 3,985,315 | 10/1976 | Newman | 242/163 |

*Primary Examiner*—Stanley N. Gilreath
*Attorney, Agent, or Firm*—Watson, Cole, Grindle & Watson

[57] ABSTRACT

A tube for insertion into a coil of flexible material wound in a series of figure-8s with a radial opening extending into the axial opening through which the inner end of the material can be drawn out without twist has a flange spaced from its free end and a second flange adjacent the free end with the space between the two flanges being substantially equal to the wall thickness of a container in which the packaged coil is to be enclosed.

The outer flange is interrupted at two points and has an outwardly bent portion. The tube is inserted from the outside into the radial opening of the coil, which is then placed inside the container with the outer end of the tube directed towards an opening in the container, which has notches therein. Upon turning the tube, the outwardly bent portions ride up on the wall of the container, so that the tube can be turned to a position in which the principal part of the outer flange engages against the outside of the wall. The tube is cut off so that it does not project beyond the outer flange. The sloping portions of the outer flange are provided with weakenings adjacent their inner ends, so that upon the assembly of the package these can be broken off and will no longer project from the outside to interfere with handling of the package.

1 Claim, 3 Drawing Figures

SCREW-IN TUBE WITH BREAKABLE TABS FOR COIL OF FLEXIBLE MATERIAL WITH INNER END PAYOUT

BACKGROUND OF THE INVENTION

1. Field of the Invention

The invention relates to a tube for the withdrawl of flexible material through a radial opening extending into an axial opening or a coil, and to package including such a coil and tube.

2. THE PRIOR ART

Various types of withdrawal tubes have been known, for example from Gordon U.S. Pat. No. 3,677,490. These tubes however have a disadvantage in that they are not firmly fixed in the package, and may be displaced to an inoperative position during shipment.

It has also been proposed to use a tube of this type having a flange spaced from its outer end and having projections on the flange which pass through notches in the wall of the container, after which the flanges turn so that the projections overlie uninterrupted portions of the container wall. It has also been proposed to slope the inner surfaces of these projections so that they can be more readily turned on the box. However, whether two or four projections are used, the portion of the box wall engaged by the projections is relatively small, and there is danger that the tubes will be pushed back into the box during handling and shipment, so that they will no longer serve adequately to guide the payout of the material.

There has been suggested another tube structure in which the tube has spaced from its outer end a first flange for engaging the outside of the coil inside the container, and a second flange adjacent the outer end and spaced from the first flange, the second flange having notches therein and having portions adjacent the notches which are sloped angularly outward, so that when the package is inserted in a container the sloped portions can pass through notches in an opening in the container wall and upon turning will ride up so that the outer flange engages the outside of the wall over substantially its whole area.

In that proposed tube, the tube extends out beyond the outer flange by a distance substantially equal to the projection of the outwardly bent portions. This construction has the disadvantage that the substantial projection makes it quite likely that the tube may be struck during handling or transit, and thus displaced, so that payout is interfered with.

SUMMARY OF THE INVENTION

According to the present invention, the tube terminates at the outer flange and does not extend beyond it. Also, the outwardly bent portions are provided with weakened sections adjacent their bases, for example, by being scored or having perforations formed therethrough, so that after the assembly of the coil within the container it is easy simply to press in the angular portions and snap them off. This nevertheless leaves the outer flanges in engagement over substantially its whole surface with the wall of the container.

DESCRIPTION OF THE PREFERRED EMBODIMENTS

Figure 1:
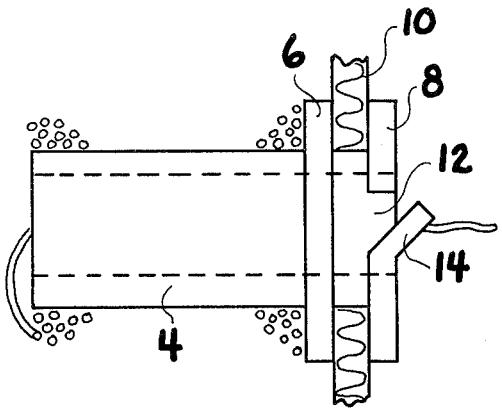
FIG. 1 shows in side elevation a tube according to the invention incorporated in a coil within a package.
Figure 2:
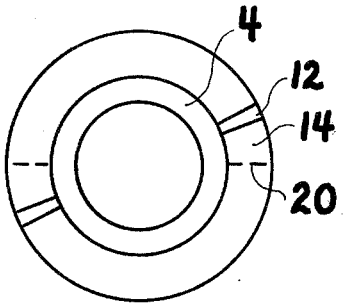
FIG. 2 is an end view from the right-hand side of FIG. 1.
Figure 3:
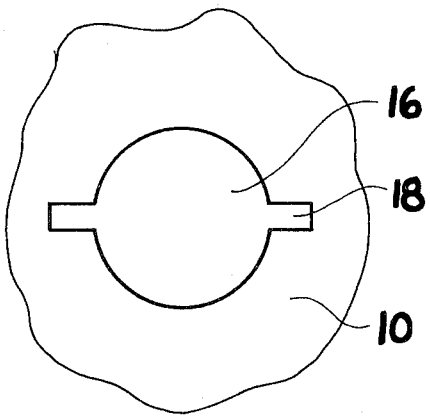
FIG. 3 is a side view of a part of the wall of the package showing the hole for receiving the tube.

Referring to the drawings, there is a package of flexible material wound as described above, that is, as shown for example in Taylor U.S. Pat. No. 2,634,922 or Gordon U.S. Pat. No. 3,677,490. Within the radial opening of this coil there is arranged a tube 4, which has spaced from its outer end a flange 6 and at its outer end a second flange 8, the space between the two flanges being substantially equal to the wall thickness of the container 10 in which the coil is to be packaged.

The outer flange has notches 12 therein at two diametrically opposite points, and at these notches is provided with outwardly angularly extending portions 14.

In the container 10 there is an opening 16 with notches 18 diametrically opposite each other.

In use, after the coil has been wound, the tube is inserted into it from the outside until the flange 6 rests against the outside of the coil. The coil is then placed in the container and the tube is brought up until the outwardly bent portions 14 are opposite notches 18. Turning of the tube then causes the outwardly bent portions to ride up on the outside of the wall 10. By turning this by approximately 90°, substantially the whole of the inner face of the flange 8 is engaged against the wall 10 which thus reduces the danger that the tube may be pushed into the package during handling.

In order to reduce the danger of interference with the device or with its handling during shipment or use, the bases of the parts 14 are provided with weakened portions 20, which may for example be gaps punched therethrough in the nature of a roulette or may be grooves. After assembly, by simply pressing on the extensions 14, they can be snapped off. Since the tube is only intended for a single use, this is not any detriment.

I claim:

1. In combination with a coil of material wound in a plurality of layers each composed of a series of figure-eights with the cross-overs progressing angularly around the package and having an axial opening therethrough and a radial opening extending through the wall of the coil into the axial opening, and a container enclosing said coil, a tube arranged in said radial opening and having a flange spaced from the free end thereof engaging the outside of the coil and a second flange spaced from the first flange towards the free end of the tube by a distance substantially equal to the thickness of the wall of the container, the wall of the container having an opening therein and notches extending outwardly from the opening, said second flange having gaps therein and the portions adjacent the gaps being sloped outwardly in the same circumferential direction, whereby when the second flange is moved towards the inside of the wall of the container said slanted portions engage in the notches extending from the opening in the wall of the container and upon turning will ride up on the outside of the wall of the container so as to position the tube in the opening in the wall of the container with the flanges positioned on opposed sides of the wall of the container, the points of connection between the outwardly extending members and the outer flange having weakened areas to permit the outwardly extending members to be broken off readily after the package is assembled, the outer end of the tube terminating at the outer face of the outer flange.

* * * * *